United States Patent [19]

Lowry

[11] Patent Number: 4,984,309

[45] Date of Patent: Jan. 15, 1991

[54] DRAIN SYSTEM

[76] Inventor: Robert D. Lowry, 330 Marguerite Ave., Cuyahoga Falls, Ohio 44221

[21] Appl. No.: 354,400

[22] Filed: May 19, 1989

[51] Int. Cl.[5] ..... E03C 1/12

[52] U.S. Cl. ..... 4/288; 4/DIG. 7

[58] Field of Search ..... 4/288, 286, 206, DIG. 7, 4/197, 198; 277/178; 285/162, 42, 56, 57, 58

[56] References Cited

U.S. PATENT DOCUMENTS

| | | | |
|---|---|---|---|
| 333,343 | 12/1885 | Schrack | 4/292 |
| 1,994,789 | 3/1935 | Redmond et al. | 4/191 |
| 2,316,724 | 4/1943 | Sperry | 4/288 |
| 2,444,340 | 6/1948 | Donahue | 4/191 |
| 2,886,829 | 5/1959 | Kadish | 277/178 |
| 3,287,742 | 11/1966 | Gaddis | 4/191 |
| 3,393,409 | 7/1968 | Politz | 4/191 |
| 4,006,498 | 2/1977 | Cuschera | 4/191 |
| 4,043,354 | 8/1977 | Brown | 137/247.33 |
| 4,090,267 | 5/1978 | Cuschera | 4/288 |
| 4,658,449 | 4/1987 | Martin | 4/292 |

*Primary Examiner*—Henry J. Recla
*Assistant Examiner*—Glenn T. Barrett
*Attorney, Agent, or Firm*—Frederick K. Lacher

[57] ABSTRACT

A shower or bathtub drain system (10,60) in which a sealing ring (16,16') is fastened to one end of a strainer body (32) or shoe (64) and inserted through the drain hole (14,58) in the bottom of the shower or bathtub from the space below the bottom surface. The sealing ring (16,16') is of a resilient material and has an upper flange (18,18') for overlapping the surfaces (20,62) at the edges of the drain hole. The installation is completed from the space above the bottom plate member (12,56) of the bathtub or shower by positioning a clamp ring (40,68) over the sealing ring flange (18,18') and then pulling the clamp ring (40,68) toward the strainer body (32) or shoe (64) by screw connectors (52,78) inserted through holes (48,80) in the clamp ring (40,68) and threaded in holes (50,76) in the strainer body (32) or shoe (64). As the clamp ring (40,48) is pulled toward the strainer body (32) or shoe (64) the sealing ring upper flange (18,18') is compressed between the clamp ring (40,68) and the bottom plate member (12,56) which seals the space between the surfaces (20,62) and the clamp ring (40,68).

15 Claims, 4 Drawing Sheets

DRAIN SYSTEM

This invention relates generally, as indicated, to a drain system for a shower or bathtub and especially to a drain system which can be installed by one person. The drain system in common use for a bathtub includes a shoe which has a threaded opening for receiving a threaded sleeve which is pushed through the drain hole and screwed into the shoe. This requires one person to hold the shoe in the space below the bathtub or shower and another person to insert the threaded sleeve through the drain hole and into the shoe. Putty or grouting is then placed between a flange on the sleeve and the bottom surface of the bathtub to make a seal. It has also been proposed to substitute screw connectors between the flange of the sleeve and the shoe to pull the sleeve and shoe together. This eliminated the threading of the sleeve in the shoe but it was still necessary to align the shoe with the drain opening and hold it in alignment for insertion in the sleeve. Also a gasket was required between the top surface of the shoe and the bottom surface of the bathtub.

The present invention is directed to a drain system in which a sealing ring member of resilient material is mounted on one end of a strainer body or shoe. The sealing ring member may then be inserted through the drain hole from the space under the bathtub or shower and has a flange which overlaps the edges of the drain hole as well as retaining the strainer body or shoe in position. A clamp ring which may be installed from a position above the bottom surface of the bathtub or shower is positioned over the flange and has holes through which threaded connectors are inserted and then threaded in threaded holes in the shoe or strainer body. By tightening the threaded connectors, the flange of the sealing ring member is compressed between the clamp ring and the bottom surface of the shower or bathtub and no grouting or putty is required.

In accordance with one aspect of the invention there is provided a drain system for conveying water through a circular opening in a bottom plate member of a water retaining container to a drain member located under the bottom plate member comprising a sealing ring member of resilient material mounted on one end of the drain member, the sealing ring member having an upper flange with an outer diameter greater than the diameter of the opening for overlapping an upper surface of the plate member, a clamp ring member having an outer diameter greater than the inner diameter of the sealing ring member for positioning over the sealing ring member, connecting means extending between the clamp ring member and the drain member for clamping the upper flange between the clamp ring member and the plate member, the sealing ring member being flexible for collapsing the flange to an outer diameter less than the diameter of the opening for inserting the upper flange through the opening from the space under the bottom plate to partially install the drain system, the sealing ring member being resilient to expand and support the drain member after insertion of the upper flange through the opening so that the clamp ring member can be positioned over the upper surface and the connecting means installed between the clamping ring member and the drain member from the space over the bottom plate member and operated to compress the upper flange and complete the installation of the drain system.

In accordance with another aspect of the invention there is provided a method of installing a drain system in a circular opening in a bottom plate member of a water-retaining container connected to a drain member in a space under the bottom plate member wherein a sealing ring member of resilient material is mounted on one end of the drain member, the sealing ring member having a flange with an outer diameter greater than the diameter of the opening for overlapping an upper surface of the plate member, a clamp ring member having an outer diameter greater than the inner diameter of the sealing ring member for positioning over the sealing ring member, connecting means between the clamp ring member and the drain member for clamping the flange between the clamp ring member and the plate member, the sealing ring member being flexible for collapsing of the flange to an outer diameter less than the diameter of the opening and being resilient for expanding the flange and supporting the drain member with the sealing ring member mounted in the opening comprising:

(a) collapsing the flange and inserting the sealing ring member through the opening from the space under the bottom plate;

(b) positioning the sealing ring member with the flange expanded to overlap the upper surface of the plate member for supporting the drain member;

(c) positioning the clamp ring member over the flange of the sealing ring member from the space over the bottom plate;

(d) installing the connecting means between the clamp ring member and the drain member; and (e) operating the connecting means to clamp the flange between the clamp ring member and the plate member at the opening.

To the accomplishment of the foregoing and related ends, the invention, then, comprises the features hereinafter fully described and particularly pointed out in the claims, the following description and the annexed drawings setting forth in detail certain illustrative embodiments of the invention, this being indicative, however, of but two of the various ways in which the principles of the invention may be employed.

Figure 1:
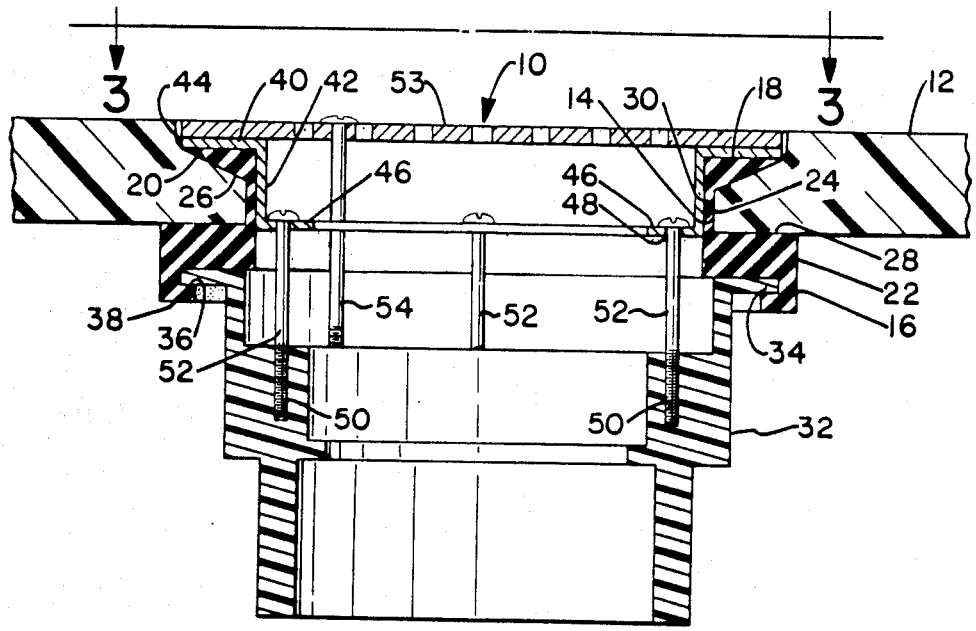
FIG. 1 is a sectional elevation of a shower drain embodying the invention installed in a shower floor with parts or the floor being broken away.
Figure 3:
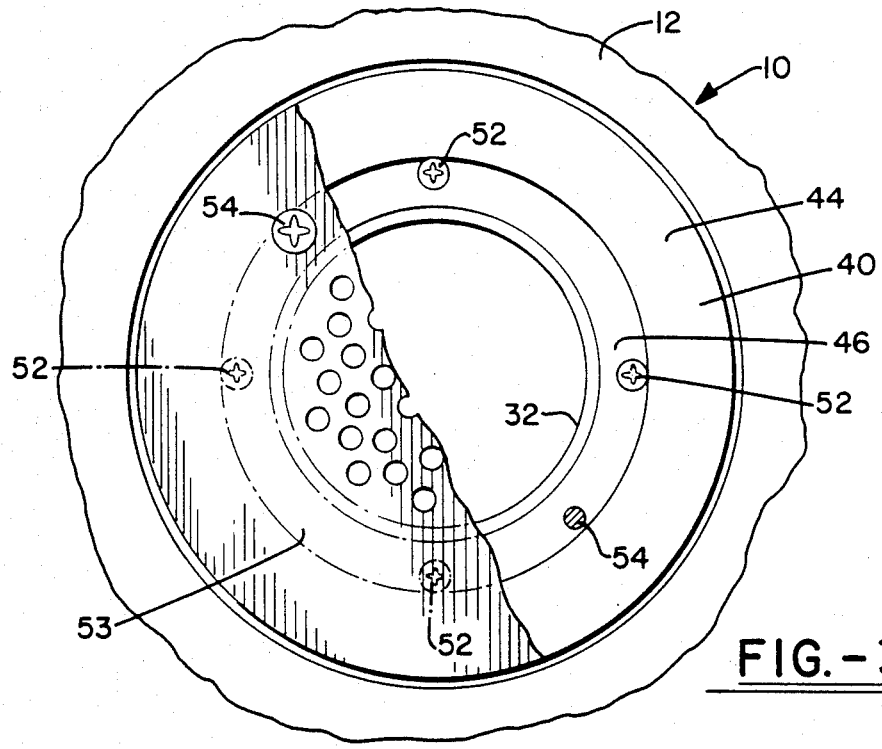
FIG. 3 is a plan view taken along line 3—3 in FIG. 1 with parts of the screen broken away.
Figure 4:
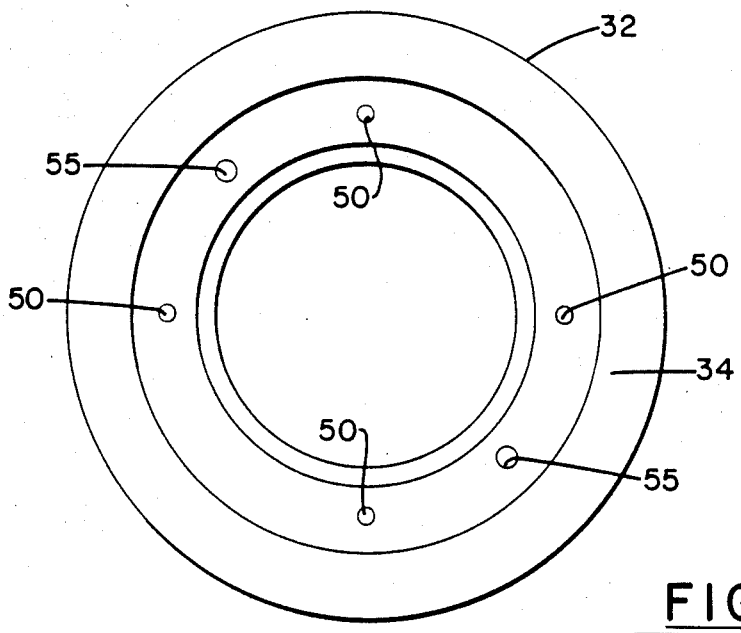
FIG. 4 is a plan view of the strainer body shown in FIG. 1.
Figure 5:
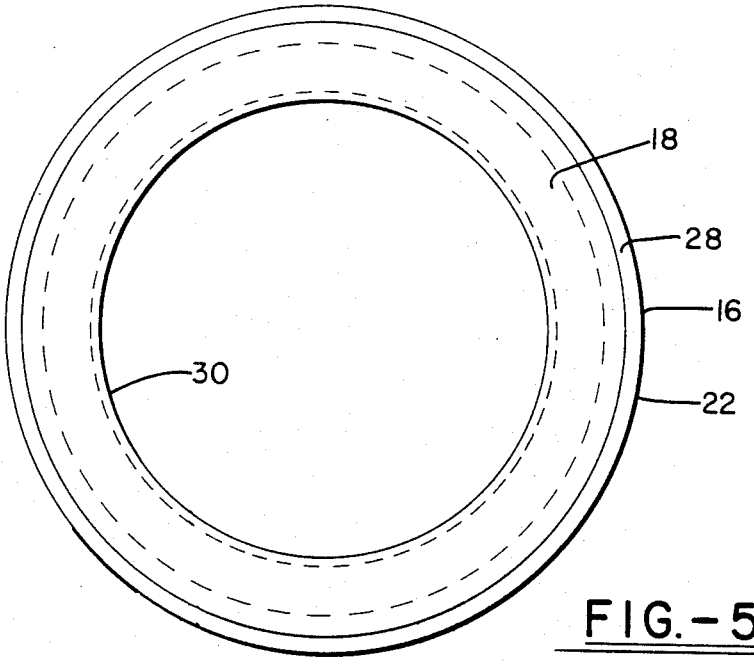
FIG. 5 is a plan view of the sealing ring member shown in FIG. 1.

Referring to FIGS. 1 and 3, a drain system 10 is shown which is especially adapted for a shower having a bottom plate member 12 which may be of fiberglass or other suitable material. A circular opening such as a drain hole 14 is provided in the bottom plate member 12. The drain system 10 includes a sealing ring member such as sealing ring 16 with an upper flange 18 having an outer diameter greater than the diameter of the drain hole 14 for overlapping an upper surface of the bottom plate member 12. The upper flange 18 may be tapered to conform with a sloped surface 20 at the drain hole 14. The sealing ring 16 also has a lower flange 22 extending radially outward in spaced relationship to the upper flange 18 forming a circumferentially extending retaining groove 24 with opposing walls 26 and 28 for overlapping both sides of the bottom plate member 12 at the drain hole 14. The retaining groove 24 has a base 30 with a diameter which is substantially the same as the diameter of the drain hole 14.

The sealing ring 16 is preferably of a resilient material such as a neoprene type rubber. The sealing ring 16 has a thickness T measured in the radial direction of about 0.0625 inches (0.15 cm) so that the portion of the sealing ring at the base 30 is easily deflected on installation at which time the upper flange 18 is collapsed to fit in the drain hole 14. Preferably width W of the groove 24 at the base 30 is substantially the same as the width of the bottom plate member 12 to support the upper flange 18 in a horizontal position. In the present embodiment, the width W is about 0.25 inches (0.64 cm).

The sealing ring 16 is mounted on a drain member such as strainer body 32 having a flanged edge 34 extending radially outward for engagement with a mounting groove 36 at a grooved edge 38 of the sealing ring 16. The flanged edge 34 extends radially outward from the strainer body 32 and the grooved edge 38 on the lower flange 22 extends radially inward for mounting of the sealing ring 16 on the end of the strainer body. The strainer body 32 may be of metal or a plastic such as ABS.

Figure 2:
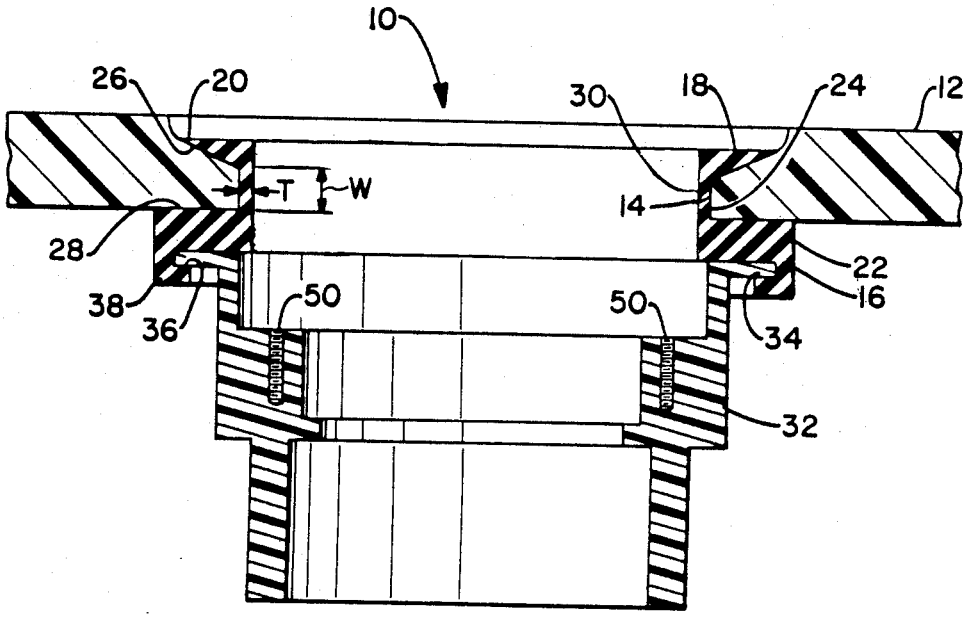
FIG. 2 is a view like FIG. 1 showing the lower part of the drain of FIG. 1 inserted in the drain opening from under the shower floor.

As shown in FIG. 2, after the sealing ring 16 is mounted on the strainer body 32 the upper flange 18 is collapsed to a diameter less than the diameter of the drain hole 14 and the upper flange inserted in the drain hole to the position shown in FIG. 2 where the upper flange 18 overlaps the sloped surface 20 of the bottom plate member 12 at the drain hole. The sealing ring 16 has sufficient resiliency to hold the sealing ring 16 and strainer body 32 in the position shown in FIG. 2. A clamp ring member such as clamp ring 40 which may be of metal has a cylindrical portion 42 with an outer diameter substantially the same as the inner diameter of the sealing ring 16 for positioning the clamp ring inside the sealing ring as shown in FIG. 1. The clamp ring 40 has an overlapping flange 44 extending radially outward from the cylindrical portion 42 for overlapping the upper flange 18 of the sealing ring 16. The outer diameter of the overlapping flange 44 is preferably greater than the inner diameter of the sealing ring 16 for positioning over the sealing ring and compressing the upper flange 18.

The clamp ring 40 also has a connecting flange 46 extending radially inward from the cylindrical portion 42 and has circumferentially spaced holes 48 in alignment with threaded holes 50 in the strainer body 32 for threaded connectors such as screws 52. After the clamp ring 40 is positioned over the sealing ring 16, the screws 52 are inserted through the holes 48 in the connecting flange 46 and threaded in the threaded holes 50 for pulling the clamp ring 40 toward the strainer body 32 and thereby compressing the resilient material of the sealing ring 16 in the upper flange 18 and lower flange 22 for sealing the drain system 10 and accommodating any variations in the thickness of the bottom plate member 12.

As shown in FIG. 3, a screen 53 is positioned over the clamp ring 40 and screen screws 54 extend through holes in the screen and in the connecting flange 46 into threaded engagement with threaded holes 55 in the strainer body 32.

With the above described construction, the drain system 10 may be installed by one person in accordance with the following method:

The sealing ring 16 is mounted on the strainer body 32 by stretching the grooved edge 38 of the sealing ring 16 over the flanged edge 34 of the strainer body. The installer then may contract the upper flange 18 to a diameter less than the diameter of the drain hole 14 and push the flange through the drain hole into an overlapping position with the sloped surface 20 of the drain hole.

The sealing ring 16 has sufficient resiliency to expand after insertion in the drain hole 14 so that the edge of the drain hole is gripped in the mounting groove 36. Also if there is a variation in the thickness of the bottom plate member 12 at the drain hole 14, the resilience of the base 30 of the retaining groove 24 in the sealing ring 16 will accommodate this difference. The resilience of the sealing ring 16 is also sufficient to support the ring and the strainer body 32 while the installer moves to a position over the bottom plate member 12. Referring to FIG. 1, the installer then positions the clamp ring 40 over the upper flange 18 of the sealing ring 16 and inserts the screws 52 through the holes 48 and into the threaded holes 50 in the drain pipe 14. The screws 52 are then turned to pull the clamp ring 40 toward the strainer body 32. This clamps the upper flange 18 of the sealing ring 16 between the overlapping flange 44 of the clamp ring 40 and the sloped surface 20 of the bottom plate member 12. It also clamps the lower flange 22 between the bottom plate member 12 and the flanged edge 34 of the strainer body 32 providing a watertight seal. The drain screen 53 may then be placed within the space above the connecting flange 46 and inside the cylindrical portion 42. The screen 53 may then be fastened to the connecting flange 46 of the clamp ring 40 by screen screws 54 engageable with the screen fastening holes 55 in the strainer body 32.

Figure 6:
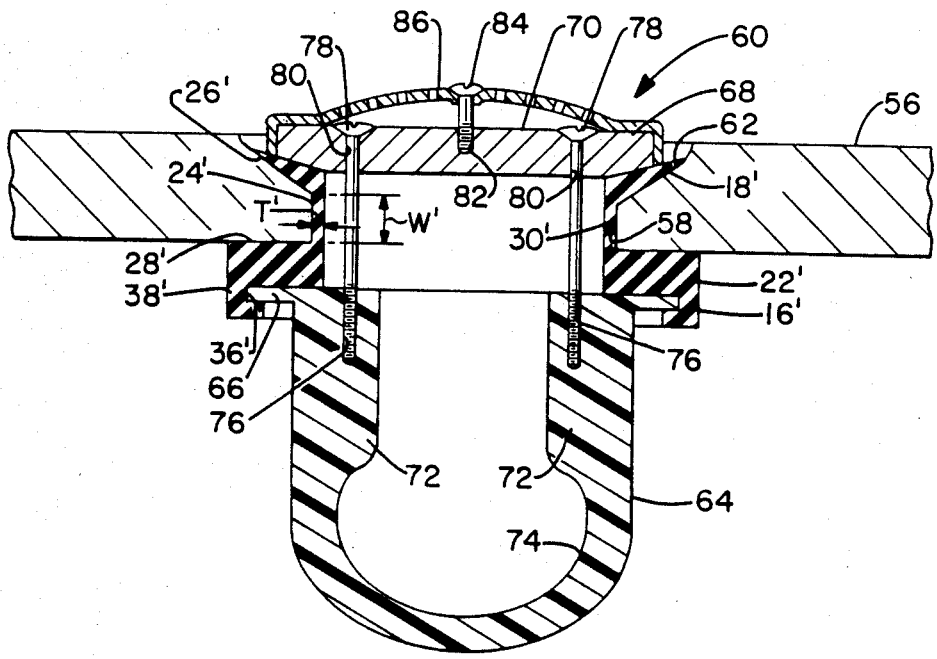
FIG. 6 is a sectional elevation of a bathtub drain embodying a modification of the invention installed in a bathtub with parts of the bathtub broken away.
Figure 7:
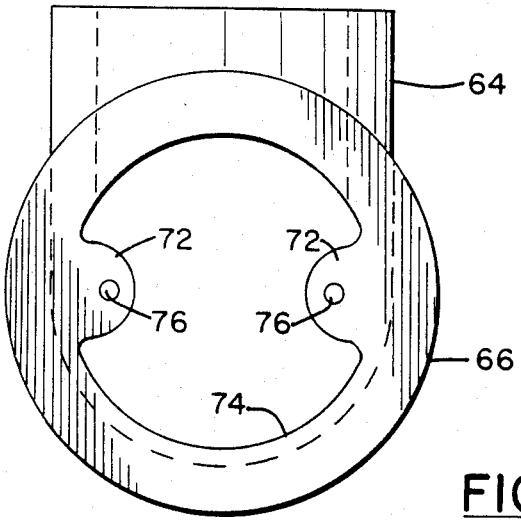
FIG. 7 is a plan view of the shoe shown in FIG. 6.
Figure 8:
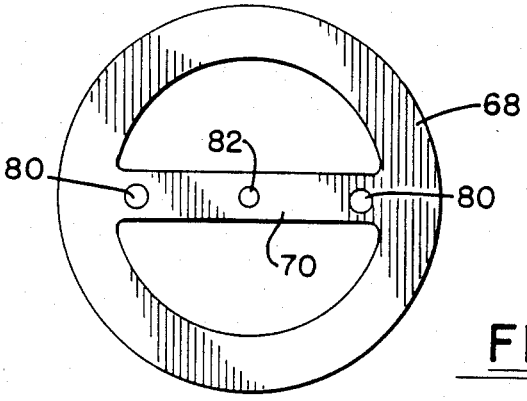
FIG. 8 is a plan view of the clamp ring shown in FIG. 6.

With reference to FIGS. 6, 7 and 8, a modification is shown in which a drain system embodying the invention is installed in a bathtub. In describing this modification, the same numerals with prime symbols will be used to identify those parts which are the same as the parts in the embodiment of FIGS. 1 through 5. Referring to FIG. 6, a bottom plate member 56 of a bathtub, which may be of fiberglass or other suitable material, has a circular opening such as a drain hole 58. A drain system 60 for the bathtub includes a sealing ring member such as sealing ring 16' with an upper flange 18' having an outer diameter greater than the diameter of the drain hole 58 for overlapping an upper surface of the bottom plate member 56. The upper flange 18' may be tapered to conform with a sloped surface 62 at the drain hole 58. The sealing ring 16' also has a lower flange 22' extending radially outward in spaced relationship to the upper flange 18' forming a circumferentially extending retaining groove 24' with opposing walls 26' and 28' for overlapping both sides of the bottom plate member 56 at the drain hole 58. The retaining groove 24' has a base 30' with a diameter which is substantially the same as the diameter of the drain hole 58.

The sealing ring 16' is preferably of a resilient material such as a neoprene type rubber. The sealing ring 16' has a thickness T' measured in the radial direction of about 0.0625 inches (0.15 cm) so that the portion of the sealing ring at the base 30' is easily deflected on installation. Preferably the width W' of the groove 24' at the base 30' is substantially the same as the width of the bottom plate member 56 to support the upper flange 18' in a horizontal position. In the present embodiment, the width W' is about 0.25 inches (0.64 cm).

The sealing ring 16' is mounted on a drain member such as shoe 64 shown in FIGS. 6 and 7. The shoe 64 has a flanged edge 66 extending radially outward for engagement with a mounting groove 36' at a grooved edge 38' of the sealing ring 16'. The flanged edge 66 extends radially outward from the shoe 64, and the grooved edge 38' on the lower flange 22' extends radially inward for mounting of the sealing ring 16' on the end of the shoe. The shoe 64 may be of metal or of a plastic such as ABS.

As shown in FIG. 6, after the sealing ring 16' is mounted on the shoe 64, the upper flange 18' is collapsed to a diameter less than the diameter of the drain hole 58 and the upper flange inserted in the drain hole to the position where the upper flange 18' overlaps the sloped surface 62 of the bottom plate member 56 at the drain hole 58. The sealing ring 16' has sufficient resilience to hold the sealing ring and shoe 64 in the position shown in FIG. 6. This part of the installation may be done by an installer operating in the space underneath the bottom plate member 56 of the bathtub.

The installer may then move to a position above the bottom plate member 56 and place a clamp ring member such as clamp ring 68 over the upper flange 18' of the sealing ring 16'. Preferably the clamp ring 68 is of metal or plastic and has an outer diameter greater than the inner diameter of the sealing ring 16'. The clamp ring 68 has a crossbar 70 extending diametrically across the opening in the clamp ring. As shown in FIG. 7, the shoe 64 has projecting bosses 72 on a radially inner surface 74 through which threaded holes 76 are located for receiving connecting means such as screws 78 extending through holes 80 in the crossbar 70. After the clamp ring 68 is placed over the upper flange 18' the screws 78 are inserted through the holes 80 and threaded in the threaded holes 76 for operating the connecting means by pulling the clamp ring 68 toward the shoe 64 and compressing the resilient material of the sealing ring 16' in the upper flange 18' and lower flange 22' for sealing the drain system 60 and accommodating any variations in the thickness of the bottom plate member 56.

The crossbar 70 may have a threaded central hole 82 for threaded engagement with a screw 84 extending through and in engagement with a screen 86 seated over the clamp ring 68 as shown in FIG. 6.

The method of installing the drain system 60 for the bathtub is substantially the same as the method of installing the drain system 10 for the shower as described hereinabove.

While certain representative embodiments and details have been shown for the purpose of illustrating the invention, it will be apparent to those skilled in the art that various changes and modifications may be made therein without departing from the spirit or scope of the invention.

What is claimed is:

1. A drain system for conveying water through a circular opening in a bottom plate member of a water retaining container to a drain member located under said bottom plate member comprising a sealing ring member of resilient material mounted on one end of said drain member, said sealing ring member having an upper flange with an outer diameter greater than the diameter of said opening for overlapping an upper surface of said plate member, a clamp ring member extending in a circle around said opening in said bottom plate member and having an outer diameter greater than an inner diameter of said sealing ring member for positioning over said sealing ring member, connecting means extending between said clamp ring member and said drain member for clamping said upper flange between said clamp ring member and said plate member to provide a permanent seal and a screen member removeably mounted on said clamp ring member over said opening, said sealing ring member being flexible for collapsing said flange to an outer diameter less than the diameter of said opening for inserting said upper flange through said opening from a space under said bottom plate to partially install said drain system, said sealing ring member being resilient to expand said upper flange and support said drain member after insertion of said flange through said opening so that said clamp ring member can be positioned over said flange and said connecting means installed between said clamp ring member and said drain member from a space over said bottom plate member and operated to pull said clamp ring member to compress said upper flange and provide a permanent seal to complete the installation of said drain system.

2. The drain system of claim 1 wherein said drain member has a flanged edge and said sealing ring member has a grooved edge providing a groove for engagement by said flanged edge of said drain member to mount said sealing ring member on said drain member.

3. The drain system of claim 2 wherein said flanged edge of said drain member extends radially outward from said drain member and said groove of said sealing ring member is on a radially inner surface of said sealing ring member.

4. The drain system of claim 1 wherein said connecting means includes screw members extending through holes in said clamp ring member and threaded through holes in said drain member.

5. The drain system of claim 4 wherein said clamp ring member has a crossbar extending diametrically across said ring member and said holes in said clamp ring member for said screw members being located in said crossbar at positions over said drain member.

6. The drain system of claim 5 wherein said drain member has projecting bosses on a radially inner surface positioned under said holes in said clamp ring member with said threaded holes in said drain member being located in said bosses.

7. The drain system of claim 1 wherein said sealing ring member also includes a lower flange spaced from said upper flange providing a circumferentially extending groove with opposing walls in said sealing ring member overlapping upper and lower sides of said plate member at said opening and said groove having a base with a diameter which is substantially the same as the diameter of said circular opening in said bottom plate member whereby said lower flange is compressed between said plate member and said drain member during operation of said connecting means.

8. The drain system of claim 7 wherein the distance between said upper flange and said lower flange at said base is substantially the same as the thickness of said bottom plate member at said circular opening.

9. The drain system of claim 8 wherein a thickness of said sealing ring member at said base of said groove measured in a radial direction is about 0.0625 in (0.159 cm) so that a portion of said sealing ring member at said base of said groove may be deflected during compression of said sealing ring member upon installation of said drain system.

10. The drain system of claim 8 wherein said distance between said upper flange and said lower flange at said base of said groove is about 0.25 in (0.64 cm) whereby said upper flange is supported in a horizontal position by said base of said sealing ring member at said groove.

11. The drain system of claim 1 wherein said clamp ring member has a cylindrical portion with an outer diameter substantially the same as the inner diameter of said sealing ring member for positioning said clamp ring member inside said sealing ring member.

12. The drain system of claim 11 wherein said clamp ring member has a connecting flange extending radially inward from said cylindrical portion at a position spaced from said upper flange providing a connecting portion having holes for said connecting means in alignment with threaded holes in said drain member.

13. The drain system of claim 11 wherein said clamp ring member has an overlapping flange spaced from said connecting flange and said overlapping flange being positioned over said upper flange of said sealing ring member for compressing said upper flange during operation of said connecting means.

14. The drain system of claim 13 wherein said connecting means includes screw members extending through holes in said connecting flange and into threaded holes in said drain member and said operation of said connecting means includes rotating said screw members.

15. A method of installing a drain system in a circular opening in a bottom plate member of a water-retaining container connected to a drain member in a space under said bottom plate member wherein a circular sealing ring member of resilient material is mounted on one end of said drain member, said sealing ring member having a flange with an outer diameter greater than the diameter of said opening for overlapping an upper surface of said plate member, a clamp ring member extending in a circle around said opening in said bottom plate member and having an outer diameter greater than an inner diameter of said sealing ring member for positioning over said sealing ring member, connecting means between said clamp ring member and said drain member for clamping said flange between said clamp ring member and said plate member to provide a permanent seal and a screen member removeably mounted on said clamp ring member over said opening, said sealing ring member being flexible for collapsing of said flange to an outer diameter less than the diameter of said opening and being resilient for expanding said flange and supporting said drain member with said sealing ring member mounted in said opening comprising:

(a) collapsing said flange and inserting said sealing ring member through said opening from the space under said bottom plate;

(b) positioning said sealing ring member with said flange expanded to overlap said upper surface of said plate member for supporting said drain member;

(c) positioning said clamp ring member over said flange of said sealing ring member from a space over said bottom plate;

(d) installing said connecting means between said clamp ring member and said drain member;

(e) operating said connecting means to clamp said flange between said clamp ring member and said plate member at said opening to provide said permanent seal; and (f) removeably mounting said screen member on said clamp ring member over said opening.

* * * * *